US008919770B2

(12) United States Patent
Mattern et al.

(10) Patent No.: US 8,919,770 B2
(45) Date of Patent: Dec. 30, 2014

(54) SYSTEM AND METHOD FOR IDENTIFICATION OF MEDIA SHEET SIZE

(75) Inventors: Frederick T. Mattern, Portland, OR (US); Brent Rodney Jones, Sherwood, OR (US); Joseph Michael Ferrara, Webster, NY (US); Adam Douglas Ledgerwood, Geneva, NY (US); Donald Richard Fess, Rochester, NY (US); Kenneth Paul Moore, Rochester, NY (US); Arthur Kahn, Cohocton, NY (US); Gordon Byron Reid, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 200 days.

(21) Appl. No.: 13/465,703

(22) Filed: May 7, 2012

(65) Prior Publication Data

US 2013/0292899 A1 Nov. 7, 2013

(51) Int. Cl.
*B65H 7/02* (2006.01)

(52) U.S. Cl.
USPC ..... 271/227

(58) Field of Classification Search
USPC ..... 271/226–228, 265.01, 258.01
See application file for complete search history.

(56) References Cited

U.S. PATENT DOCUMENTS 5,056,771 A * 10/1991 Beck et al. ..... 271/114
5,328,166 A 7/1994 Hokamura
5,464,204 A 11/1995 Suzuki
5,596,399 A 1/1997 Dempsey et al.
5,619,240 A 4/1997 Pong et al.
5,671,163 A 9/1997 Iida
5,828,818 A 10/1998 Anzai
5,918,877 A 7/1999 Takei et al.
5,980,132 A * 11/1999 Kawai ..... 400/56
6,145,376 A 11/2000 Elgee
6,154,240 A 11/2000 Hickman
6,173,952 B1 1/2001 Richards et al.
6,289,730 B1 9/2001 Elgee
6,313,928 B1 11/2001 Yu
6,674,981 B2 1/2004 Sugimoto
6,866,354 B2 3/2005 McClellan et al.
7,111,841 B2 9/2006 Jacobs et al.
7,280,782 B2 * 10/2007 Maeda et al. ..... 399/81
7,369,265 B1 * 5/2008 Lapstun et al. ..... 358/1.18
7,548,328 B2 6/2009 Hult et al.
7,618,039 B2 11/2009 Mandai et al.
8,090,280 B2 * 1/2012 Shim et al. ..... 399/49
2005/0017430 A1 * 1/2005 Takahashi et al. ..... 271/10.01
2005/0133983 A1 6/2005 Jacobs et al.
2008/0038028 A1 * 2/2008 Takezawa ..... 399/367
2008/0193151 A1 * 8/2008 Shim et al. ..... 399/40
2009/0051101 A1 2/2009 Yamagishi

* cited by examiner

*Primary Examiner* — Thomas Morrison
(74) *Attorney, Agent, or Firm* — Maginot Moore & Beck LLP

(57) ABSTRACT

A printer extracts a media sheet from a plurality of media sheets in a media supply and moves the media sheet along a media path. A plurality of sensors on the media path generate signals as the media sheet moves past the sensors, and the printer identifies a cross-process direction dimension of the media sheet with references to signals generated by the sensors. The printer identifies the dimension of the print medium without requiring media size sensors in the media supply.

9 Claims, 7 Drawing Sheets

SYSTEM AND METHOD FOR IDENTIFICATION OF MEDIA SHEET SIZE

TECHNICAL FIELD

This disclosure relates generally to devices for transporting print media in a printer and, more particularly, to devices for identifying the size of media sheets in a printer.

BACKGROUND

Many imaging devices, such as printers, photocopiers, and multi-function imaging devices, store a supply of media sheets, such as paper sheets, in one or more internal trays. The sheets are vertically stacked within the trays by a user or service technician. Media trays are sized and configured to hold hundreds or thousands of sheets. In many printers, a single media tray is configured with adjustable structure to enable the tray to accept stacks of media sheets in various sizes. For example, a single media tray can accept letter, A4, and legal sized sheets, among other sizes. The printer operates in different print modes to form images on each size of media sheets.

Some printers accept manual input from an operator to identify the size of media sheets stored in the media tray. Manual identification may be inconvenient, however, for the operator, and if the size of media sheets in the media supply is misidentified, then the printer may malfunction during operation. Other printers identify the size of media sheets prior to printing on the media sheets using one or more sensors that are located within the media supply. For example, sensors in the media supply can identify both the length and the width of media sheets before the printer starts printing images on the media sheets. Some existing printers can verify if a media sheet is approximately the same as the media sheet sizes indicated by the media supply sensors using one or more sensors in the media path during a print job. If a media sheet is substantially smaller than the size indicated by the sensors in the media supply, the printer can suspend or cancel the print job until the media supply is filled with the appropriately sized media sheets.

While existing media supplies can identify the size of media sheets, the sensors in the media supplies also have drawbacks. For example, media supply trays are often implemented as slideable trays that are opened and closed frequently to replenish paper in the printer. Sensors located in the media tray can be damaged or misaligned during continued use of the media tray. Additionally, sensors located in the media supply increase the cost of manufacturing the media tray and may decrease the reliability of the printer. Consequently, printers that identify the sizes of media sheets used in the printer more robustly would be beneficial.

SUMMARY

In one embodiment, a printer that identifies the sizes of media sheets has been developed. The printer includes a media supply configured to store a plurality of media sheets, a media transport device configured to extract one media sheet from the plurality of media sheets in the media supply and move the one media sheet in a process direction through a media path in the printer, a staging portion of the media path located in the process direction from the plurality of sensors, a plurality of sensors arranged in a cross-process direction across the media path, and a controller operatively connected to the media transport device and the plurality of sensors. The controller is configured to operate the media transport device to extract one media sheet from the plurality of media sheets in the media supply and move the first media sheet in the process direction along the media path, identify a cross-process direction dimension of the one media sheet with reference to a plurality of signals generated by the plurality of sensors in response to the one media sheet moving through the media path past the plurality of sensors, operate the media transport to move the one media sheet into the staging portion of the media path, and deactivate the media transport to hold the one media sheet in the staging portion of the media path prior to printing an image on the media sheet.

In another embodiment, a method of operating a printer to identify the size of a media sheet in the printer has been developed. The method includes extracting one media sheet from a plurality of media sheets in a media supply with a media transport device, moving the one media sheet along a media path in a process direction with the media transport device past a plurality of sensors arranged in a cross-process direction across the media path, identifying, with a controller, a cross-process dimension of the one media sheet with reference to a plurality of signals generated by the plurality of sensors in response to the one media sheet moving past the plurality of sensors, continuing to move the one media sheet to a staging portion of the media path located in the process direction from the plurality of sensors, and deactivating the media transport device to hold the one media sheet in the staging portion of the media path prior to printing an image on the media sheet.

DETAILED DESCRIPTION

Figure 1:
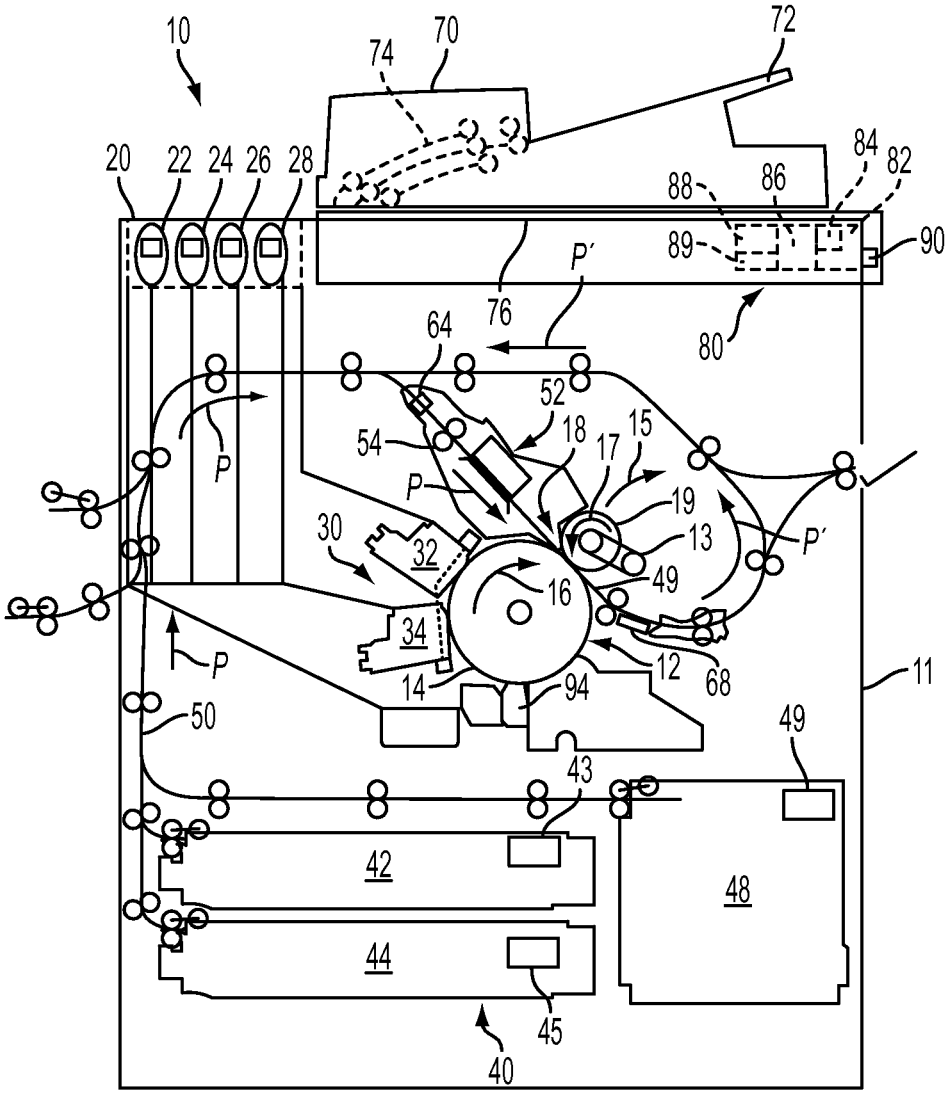
FIG. 1 is a schematic diagram of an inkjet printer that is configured to identify the size of media sheets stored in a media supply without using media size sensors located in the media supply.

For a general understanding of the environment for the devices and methods disclosed herein as well as the details for the devices and methods, reference is made to the drawings. In the drawings, like reference numerals designate like elements.

In this document, the term "printer" refers to any device that produces ink images on a print medium. As used herein, the term "media sheet" refers to a single sheet of material that passes through a printer to receive an ink image. The printer produces an image on one or both sides of the media sheet in a simplex or duplex print mode, respectively. A common form of media sheet is a paper sheet in various sizes including letter, A4, and legal sized paper sheets. A stack of media sheets includes a series of media sheets arranged with a surface of each sheet in the stage engaging a surface of another sheet in the stack except for the top sheet, which is exposed.

As used herein the term "process direction" refers to a direction of travel of a media sheet as the media sheet moves through a media path in a printer. The media sheet travels along the media path through a print zone to receive a printed image, and can also pass through a duplex portion of the media path to return to the print zone to receive another image on a second side of the media sheet. As used herein, the term "process direction dimension" refers to a length of the side of the media sheet that is parallel to the process direction. As used herein, the term "cross-process direction" refers to a direction that is perpendicular to the process direction along the surface of the media sheet. As used herein, the term "cross-process direction dimension" refers to a length of the side of the media sheet that is parallel to the cross-process direction. Different media path configurations used in various printer embodiments can orient the media sheet differently in the process and cross-process direction. For example, a letter sized media sheet has a length of 279 mm and a width of 216 mm. In one printer, the media path moves the media sheet in the process direction length-wise where the process direction dimension is the length of the media sheet and the cross-process direction dimension is the width of the media sheet. In another printer, however, the media path moves the media sheet in the process direction width-wise where the process direction dimension is the width of the media sheet and the cross-process direction dimension is the length of the media sheet.

FIG. 1 depicts an indirect inkjet printer 10 that is configured to identify the sizes of media sheets held in multiple media supplies without requiring sheet size sensors in the media supplies. As illustrated, the printer 10 includes a frame 11 to which is mounted directly or indirectly the operating subsystems and components of the printer that are described below. The phase change ink printer 10 includes an imaging member 12 that is shown in the form of a rotatable imaging drum, but can equally be in the form of a supported endless belt. The imaging member 12 has an image receiving surface 14, which provides a surface for formation of ink images. An actuator 94, such as a servo or electric motor, engages the imaging member 12 and is configured to rotate the imaging member 12 in direction 16. In the printer 10, the actuator 94 varies the rotational rate of the imaging member 12 during different printer operations including maintenance operations, image formation operations, and transfixing operations. A transfix roller 19 rotatable in the direction 17 loads against the surface 14 of drum 12 to form a transfix nip 18 within which ink images formed on the surface 14 are transfixed onto a heated print medium 49. A transfix roller position actuator 13 is configured to move the transfix roller 19 into the position depicted in FIG. 1 to form the transfix nip 18, and to move the transfix roller 19 in direction 15 to disengage the transfix nip 18 and imaging member 12.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 1, both of the printhead assemblies 32 and 34 receive the melted CMYK ink from the ink sources 22-28. In another embodiment, each of the printhead assemblies 32 and 34 is configured to print a subset of the CMYK ink colors. Alternative printer configurations print a single color of ink or print a different combination of ink colors.

The phase change ink printer 10 includes a substrate supply and handling subsystem 40. The substrate supply and handling subsystem 40, for example, includes sheet or media supplies 42, 44, 48, of which media supply 48, for example, is a high capacity paper supply or feeder for storing and supplying image receiving substrates in the form of a cut sheet print medium 49. Each of the media supplies 42, 44, and 48 is formed as a drawer that engages the housing 11 on a set of rails. The drawers slide out from the housing 11 to enable an operator to insert stacks of media sheets having varying sizes into the media supplies. The media supplies 42, 44, and 48 include drawer sensors 43, 45, and 49, respectively. The drawer sensors generate signals when each of the media supplies 42, 44, and 48 is opened and closed. The controller 80 identifies when one of the media supplies has been opened and closed with reference to the signals from the drawer sensors 43, 45, and 49. Unlike prior art media supplies, the media supplies 42, 44, and 48 do not include sensors that identify the sizes of media sheets that are stored in the media supplies. Each of the media supplies 42, 44, and 48 can be configured to store a predetermined range of media sizes. For example, each of the media supplies 42, 44, and 48 can store letter, A4, and legal sized media sheets.

The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

One or both of the media transport path 50 and the pre-heater assembly 52 are configured to heat the print medium 49 with a range of predetermined temperatures before the print medium 49 passes through the transfix nip 18. In one configuration, the thermal output of the pre-heater assembly is adjusted to raise or lower the temperature of the print medium 49. In another configuration, the media transport path 50 adjusts the speed of the print medium 49 as the print medium 49 moves past the pre-heater assembly 52 in the process direction P.

Media sources 42, 44, 48 provide image receiving substrates that pass through media transport path 50 to arrive at transfix nip 18 formed between the imaging member 12 and transfix roller 19 in timed registration with the ink image formed on the image receiving surface 14. As the ink image and media travel through the nip, the ink image is transferred from the surface 14 and fixedly fused to the print medium 49 within the transfix nip 18 in a transfix operation. In a duplexed configuration, the media transport path 50 passes the print medium 49 through the transfix nip 18 a second time for transfixing of a second ink image to a second side of the print medium 49. In the printer 10, the media transport path 50 moves the print medium in a duplex process direction P', and returns the print medium 49 to the transfix nip 18. The first side of the print medium 49 carries the first ink image engaging the transfix roller 19 and the second side of the print medium 49 receives a second ink image from the imaging member 12.

Operation and control of the various subsystems, components and functions of the printer 10 are performed with the aid of a controller or electronic subsystem (ESS) 80. The ESS or controller 80, for example, is a self-contained, dedicated minicomputer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data and print job parameters associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions. The instructions and data required to perform the programmed functions are stored in the memory 84 that is associated with the processors or controllers. The processors, their memories, and interface circuitry configure the printer 10 to form ink images, and to control the operations of the printer components and subsystems described herein for identifying the sizes of media sheets in the media supplies 42, 44, and 48. The components in the controller 80 are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 operates the inkjets in the printhead assemblies 32 and 34 to eject a plurality of ink drops onto the surface 14 of the imaging member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors.

The printer 10 includes skew sensors 64 that are located before the transfix nip 18 along the media path. The skew sensors 64 can include two or more optical or mechanical sensors that are arranged in the cross-process direction across the media path to engage the media sheet 49. The skew sensors 64 identify if the media sheet 49 has rotated about an axis that is perpendicular to the surface of the media sheet, also referred to as the "Z-axis". The controller 80 receives the signals from the skew sensors 64 and adjusts the operation of rollers in the media transport 50 to reduce or eliminate the identified skew before the media sheet 49 passes through the transfix nip 18 to receive an ink image. For example, the printer 10 adjusts the rotational velocity of rollers 54 in the media transport 50 to compensate for skew in the media sheet 49 as the media sheet 49 approaches the transfix nip 18. As described below, the skew sensors 64 can also identify the cross-process direction dimension and process direction dimension of the media sheet 49.

Figure 2A:
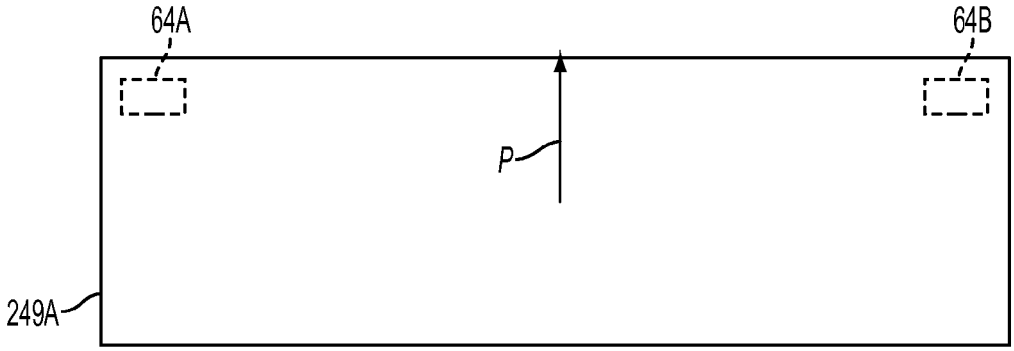
FIG. 2A is a simplified top view of a media sheet in a media path of the printer of FIG. 1 passing sensors arranged in the media path.
Figure 2B:
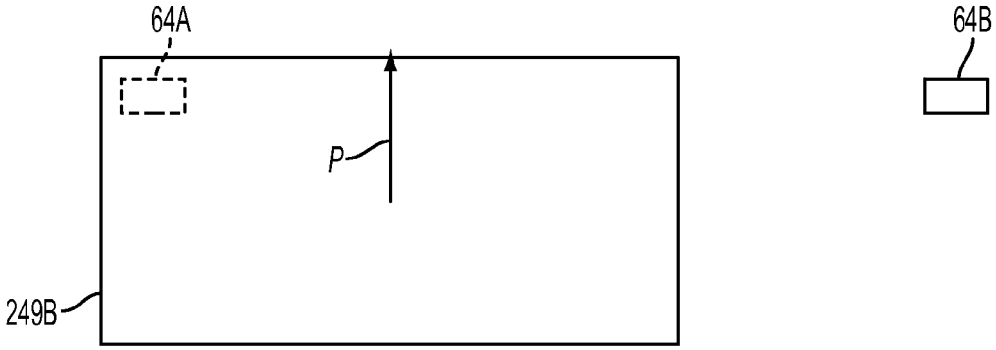
FIG. 2B is a simplified top view of another media sheet in a media path of the printer of FIG. 1 passing sensors arranged in the media path.

FIG. 2A and FIG. 2B depict two skew sensors 64A and 64B arranged across the media path 50 in the cross-process direction. In FIG. 2A, a media sheet 249A moves in the process direction P and engages both of the skew sensors 64A and 64B. The skew sensors 64A and 64B both generate a signal in response to engaging the media sheet 249A. The controller 80 identifies that the cross-process direction dimension of the media sheet 249A is at least as large as a predetermined distance that separates the skew sensors 64A and 64B.

In FIG. 2B, another media sheet 249B has a smaller cross-process direction dimension and only activates the skew sensor 64B as the media sheet 249B moves in the process direction P. The controller 80 identifies that the cross-process direction dimension of the media sheet 249B is less than the predetermined between the skew sensors 64A and 64B in response to receiving a signal from only sensor 64A. While FIG. 2A and FIG. 2B depict two skew sensors, alternative embodiments include three or more skew sensors arranged in the cross-process direction. Additional skew sensors enable the controller 80 to identify the cross-process direction dimension of the media sheet with greater precision with reference to the number of skew sensors that engage the media sheet in the media path.

Figure 2C:
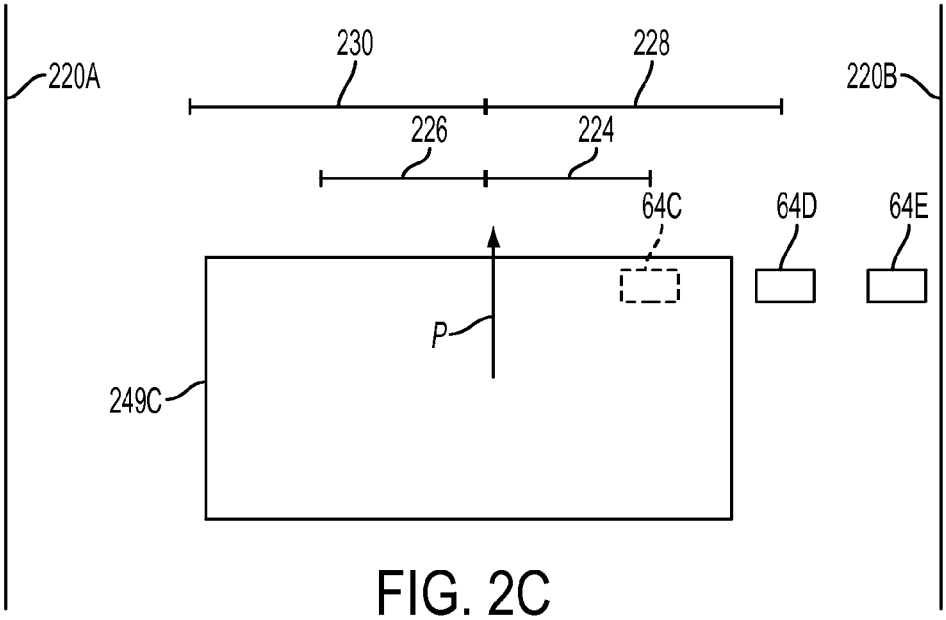
FIG. 2C is a simplified top view of another media sheet in a media path that centers the media sheet in the cross-process direction as the media sheet passes sensors arranged in the media path.

FIG. 2C depicts another configuration of the media path. In FIG. 2C, the media path is configured to center a media sheet 249C at equal distances from the cross-process direction edges 220A and 220B of the media path. The media sheet 249C moves in the process direction P past skew sensors 64C, 64D, and 64E. In the configuration of FIG. 2C, the skew sensors 64C-64E are only arranged on one side of the media path. The media sheet 249C activates the skew sensor 64C, but does not activate either of sensors 64D and 64E. Because the media sheet 249C is centered in the cross-process direction, the signals from the sensors 64C-64E indicate that the media sheet 249 has a cross-process direction dimension of at least twice the cross-process direction offset between the center of the media path and the sensor 64C, represented by dimension lines 224 and 226. Additionally, because the sensor 64D is activated, the cross-process direction dimension of the media sheet 249D is less than twice the cross-process direction offset between the center of the media path and the sensor 64D, represented by dimension lines 228 and 230.

Figure 2D:
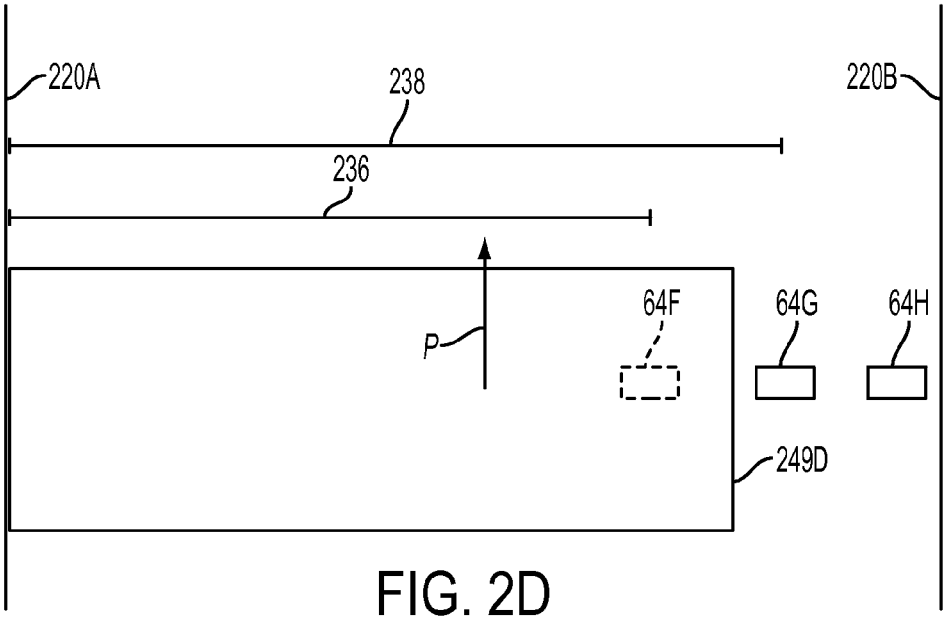
FIG. 2D is a simplified top view of another media sheet in a media path that aligns the media sheet proximate to one edge of the cross-process direction as the media sheet passes sensors arranged in the media path.

FIG. 2D depicts another configuration of the media path. In FIG. 2D, the media path is configured to align an edge of the media sheet 249D with an edge 220A of the media path, with the media sheet 249D extending toward the other edge 220B in the cross-process direction. The media sheet 249D moves in the process direction P past sensors 64F, 64G, and 64H. In FIG. 2D, the media sheet 249D activates the sensor 64F, but does not activate either of sensors 64G and 64H. Because the print medium is aligned with the edge 220A of the media path, the signal from the sensor 64F indicates that the cross-process direction dimension of the media sheet 249D is at least as large as the cross-process direction offset 236 between the sensor 64F and the edge of the media path 220A. Additionally, because the sensor 64G is not activated, the cross-process direction dimension of the media sheet 249D is less than the cross-process direction offset 238 between the sensor 64G and the edge of the media path 220A.

In any of the configurations of FIG. 2A-FIG. 2D, sensors 64 generate signals that identify a range of potential dimensions for a media sheet in the cross-process direction. Some printers are configured to accept media sheets that only correspond to a certain number of sizes. For example, a media supply can be configured to accept letter (216 mm×279 mm), A4 (210 mm×297 mm), and legal (216 mm×356 mm) sized media sheets. The sensors 64 can be arranged to indicate if a media sheet most closely corresponds to one of the predetermined media sizes even if the sensors do not generate a precise measurement of the cross-process direction dimension of the print medium. Since each print medium also has a predetermined process direction dimension, the printer 10 can identify the size of the media sheet using both data from sensors 64 for the cross-process direction dimension and the process direction dimension in comparison to predetermined sizes of media sheets.

Figure 3A:
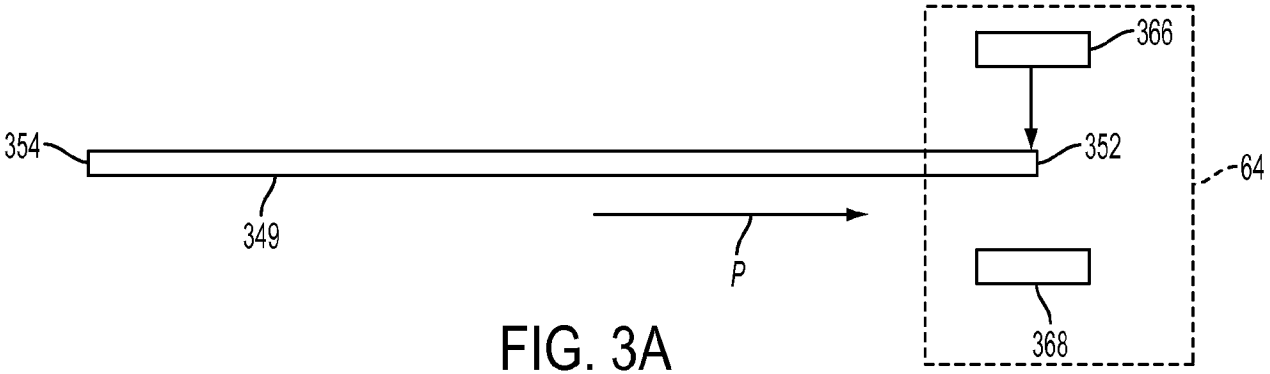
FIG. 3A is a simplified side view of a media sheet and an optical sheet sensor in a media path of the printer of FIG. 1

FIG. 3A depicts one configuration of the skew sensors 64. In FIG. 3A, the skew sensors 64 include an optical emitter 366 and optical detector 368. The optical emitter 366 generates light, and the optical detector 368 detects the light from the optical emitter 366 unless an object, such as the media sheet 349, passes between the optical emitter 366 and optical detector 368 along the media path 50. The skew sensors 64 include two or more sets of optical emitters and optical detectors arranged as shown in FIG. 2A and FIG. 2B to identify skew and to identify the dimensions of the media sheet. The skew sensors 64 generate one signal when the optical detector 368 detects the light from the optical emitter 366 and generate another signal when the media sheet 349 interrupts the light from the optical emitter 366. The controller 80 identifies when a leading edge 352 of the media sheet 349 interrupts the light beam and when a trailing edge 354 of the media sheet 349 passes skew sensors 64 and the light beam is restored with reference to the signals from the optical detector 368.

Figure 3B:
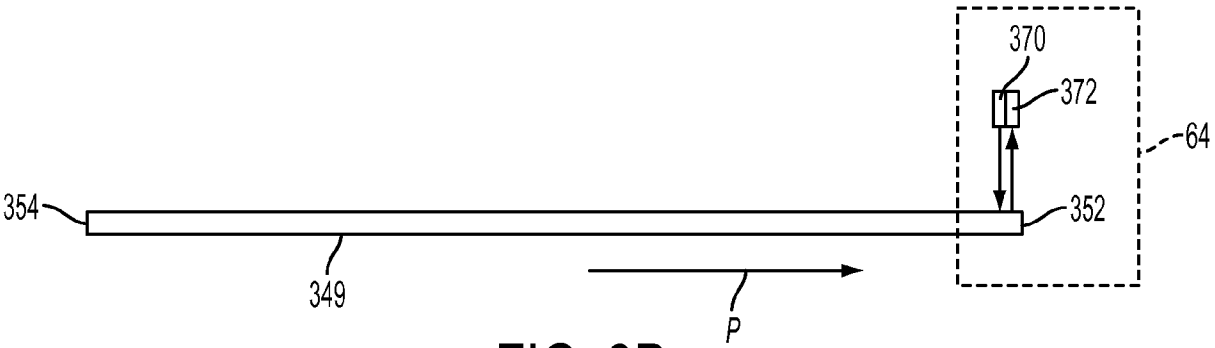
FIG. 3B is a simplified side view of a media sheet and another optical sheet sensor in a media path of the printer of FIG. 1

FIG. 3B depicts another configuration of the skew sensors 64. In FIG. 3B, the skew sensors 64 include a combined optical emitter 370 and optical detector 372. The optical emitter 370 generates light that reflects from the surface of the print medium 349. The optical detector 372 detects the light reflected from the media sheet. The optical detector 372 generates one signal when the media sheet 349 reflects the light, and another signal when no media sheet is present and the optical detector does not receive the reflected light. The controller 80 identifies when the media sheet 349 begins to reflect light as the leading edge 352 passes the skew sensors 64, and when the trailing edge 354 of the media sheet 349 passes skew sensors 64 and the optical detector 372 does not receive the reflected light.

Figure 4A:
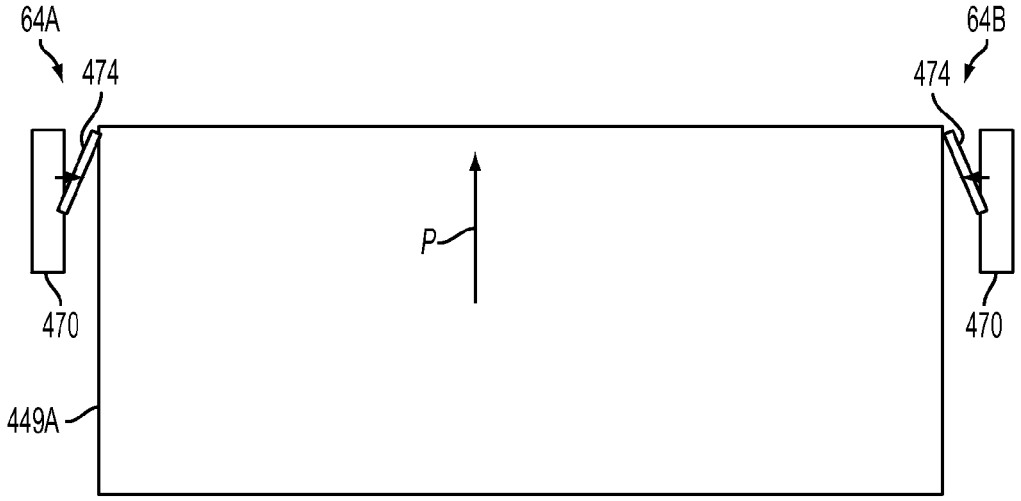
FIG. 4A is a simplified top view of a media sheet passing mechanical sheet sensors in a media path of the printer of FIG. 1.

FIG. 4A depicts a plan view of two mechanical skew sensors 64A and 64B and a media sheet 449A. Each of the mechanical sensors 64A and 64B includes a moveable arm or flag 474, which is attached to a pivot on a mechanical sensor body 470. The media sheet 449A rotates the flags 474 in each of mechanical sensors 64A and 64B as the media sheet 449A moves between the sensors 64A and 64B in the process direction P. In one configuration, the flags 474 open or close an electrical circuit in the sensor body 470 when engaging the media sheet, and the sensors 64A and 64B each generate a signal corresponding to the engagement of the media sheet. In another embodiment, the flags 474 block an optical detector when rotated into the positions depicted in FIG. 4A, and the sensors 64A and 64B generates a signal indicating that the media sheet 449A is engaging the sensors. The flags 474 are mechanically biased with, for example, a spring to return the flag to a position that is approximately perpendicular to the process direction P after the media sheet 449A passes the sensors 64A and 64B. The controller 80 identifies the length of time that the media sheet engages the sensors 64A and 64B, and identifies the length of the media sheet in the process direction P with reference to the time and the predetermined velocity of the media sheet 449A in the process direction P.

Figure 4B:
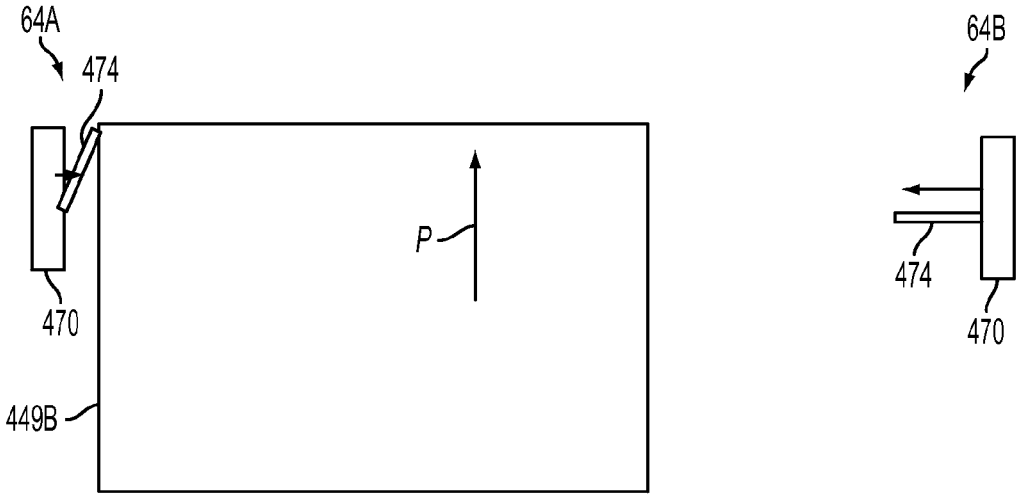
FIG. 4B is a simplified top view of another media sheet passing mechanical sheet sensors in a media path of the printer of FIG. 1.

FIG. 4B depicts another media sheet 449B engaging the sensor 64A. The media sheet 449B has a shorter dimension in the cross-process direction and the media sheet 449B only engages the sensor 64A, while the sensor 64B remains in a default position. Consequently, only the sensor 64A generates a signal as the media sheet 449B moves the in process direction P. The controller 80 detects that the skew sensor 64A is the only sensor that generates a signal, which enables the controller to identify the media sheet 449B as having a cross-process direction dimension that is less than a predetermined cross-process direction distance between the skew sensors 64A and 64B.

Referring again to FIG. 1, the printer 10 includes an optical sensor 68 that is located after the transfix nip 18 in the print zone. The optical sensor 68 includes an array of photodetectors that extend across the media path in the cross-process direction. Each of the photodetectors detects light reflected from the surface of the print medium 49. During a printing operation, the photodetector 68 detects light reflected from ink markings and the surface of the media sheet 49. The controller 80 receives image data corresponding to the light reflected from the ink image and the surface of the media sheet 49 to identify inkjets in the printhead units 32 and 34 that fail to eject ink drops or eject ink drops onto incorrect locations of the media sheet 49. In one embodiment, the optical sensor 68 includes an arrangement of 300 photodetectors per inch to detect ink drops on the media sheet with a resolution of 300 dots per ink (DPI) in the cross-process direction. As described below, the optical sensor 68 can also be configured to identify the cross-process direction and process direction dimensions of media sheets in the printer 10.

Figure 5A:
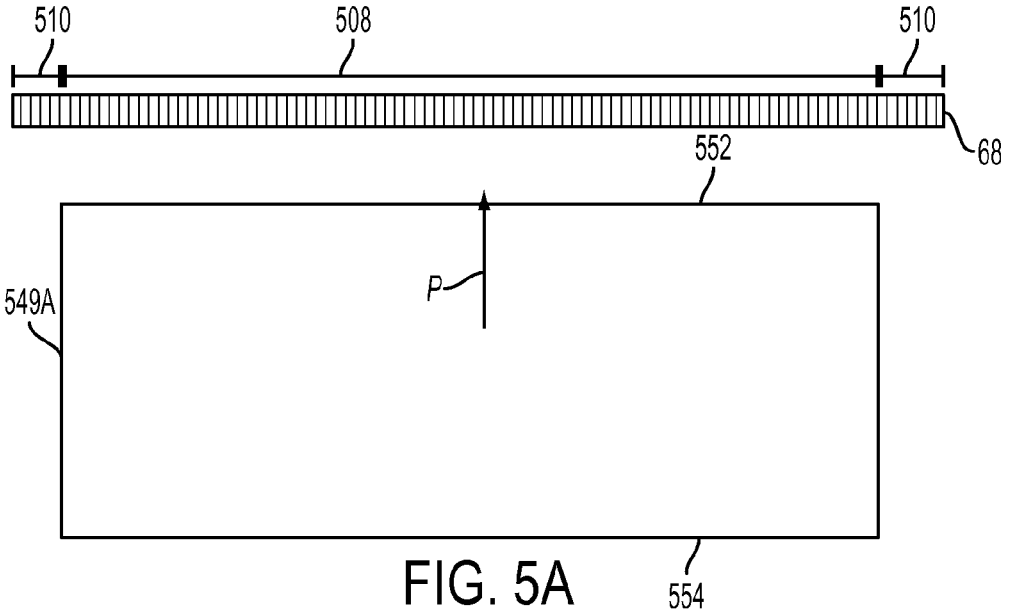
FIG. 5A is a simplified top view of a media sheet in a media path of the printer of FIG. 1 and an optical sensor array arranged in the media path.

FIG. 5A depicts the optical sensor 68 and a media sheet 549A. The media sheet 549A moves in the process direction P past the optical sensor 68. As described above, the optical sensor 68 includes a plurality of photodetectors arranged in the cross-process direction. As the media sheet 549A passes the optical sensor 68 in the process direction, some of the photodetectors in the optical sensor 68 detect light reflected from the surface of the media sheet 549A. During a normal printing operation, the level of reflected light varies across the width of the media sheet 549A because ink printed on the surface of the media sheet 549A affects the amount of reflected light that reaches each of the photodetectors. When detecting the size of the media sheet 508, however, the printer 10 does not transfer ink onto the surface of the media sheet, and most print media present a surface with generally uniform reflectivity to the optical sensor 68.

As the media sheet 549A passes the optical sensor 68, an array of photodetectors 508 generates a signal. Another set of photodetectors 510 in the optical sensor 68 generate a different signal because the media sheet 549A does not pass those photodetectors. The controller 80 identifies a cross-process direction dimension of the media sheet 549A with reference to the number of photodetectors 508 that detect light reflected from the media sheet 549A. Each photodetector has a predetermined size in the cross-process direction, and the controller 80 multiplies the predetermined size by the number of photodetectors 508 to identify the cross-process direction dimension of the media sheet 549A.

Figure 5B:
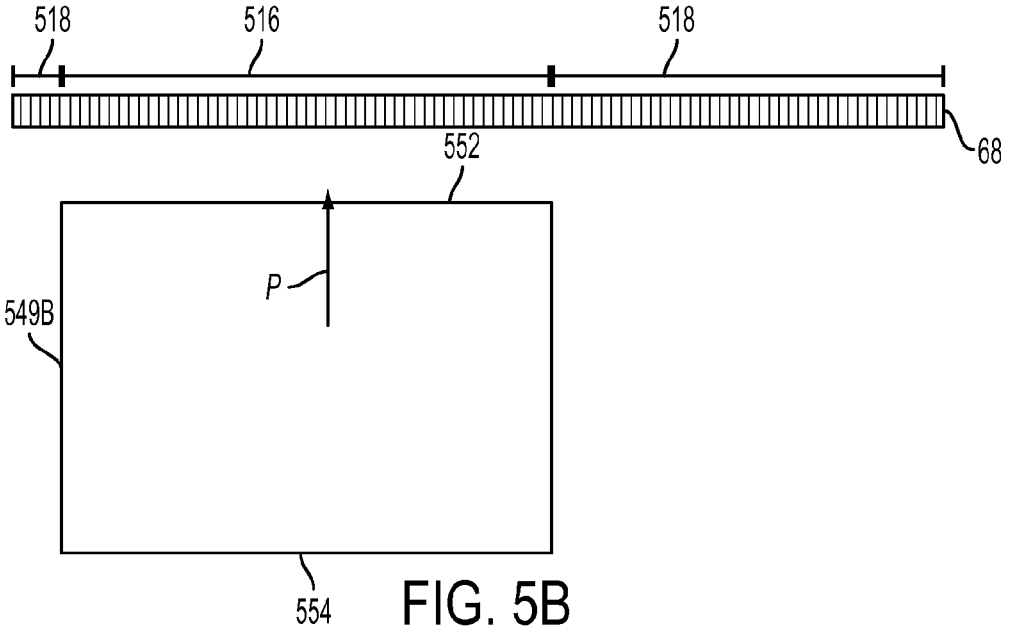
FIG. 5B is a simplified top view of another media sheet in a media path of the printer of FIG. 1 and an optical sensor array arranged in the media path.

FIG. 5B depicts another media sheet 549B approaching the optical sensor 68. The media sheet 549B has a smaller size in the cross-process direction than the media sheet 549A, and a smaller number of photodetectors 516 generate a signal from light reflected from the media sheet 549B. The remaining photodetectors 518 do not detect light reflected from the media sheet 549B. The controller 80 multiplies the predetermined size of each photodetector by the number of photodetectors 516 to identify the cross-process direction dimension of the media sheet 549B. As described above, the optical sensor 68 can include an arrangement of photodetectors with a density of 300 photodetectors per inch or higher in some embodiments. Consequently, the plurality of photodetectors in the optical sensor 68 can identify the cross-process direction dimension of the media sheets 549A and 549B with an accuracy of better than 0.01 inches. The optical sensor 68 can be used to identify media sheets of various common sizes, such as A4 or letter, and to identify smaller variations in the size of the media sheets that can occur due to errors in the manufacturing process of the media sheets. In another embodiment, an optical sensor 68 with a lower resolution can be used to identify the sizes of media sheets with reference to predetermined media sheet size standards including letter, A4, and legal sized sheets.

In FIG. 5A and FIG. 5B, the media sheet moves in the process direction P past the optical sensor 68 at a predetermined velocity. The controller 80 identifies a first time when a leading edge 552 of the media sheet passes the optical sensor 68 and a second time when a trailing edge 554 of the media sheet passes the optical sensor 68. The controller 80 identifies the process direction of the media sheet by multiplying the difference between the first and second times by the predetermined velocity of the media sheet in the process direction P.

While FIG. 1 depicts an inkjet printer 10 for illustrative purposes, other printer configurations that include sensors in the media path can also be used to identify the process direction and cross-process directions of the media sheet. For example, direct inkjet printers, laser printers, LED printers, and other printers that include either or both of the skew sensors and optical sensors described herein or equivalents thereof can be configured to identify the dimensions of media sheets using the processes described in this document.

Figure 6:
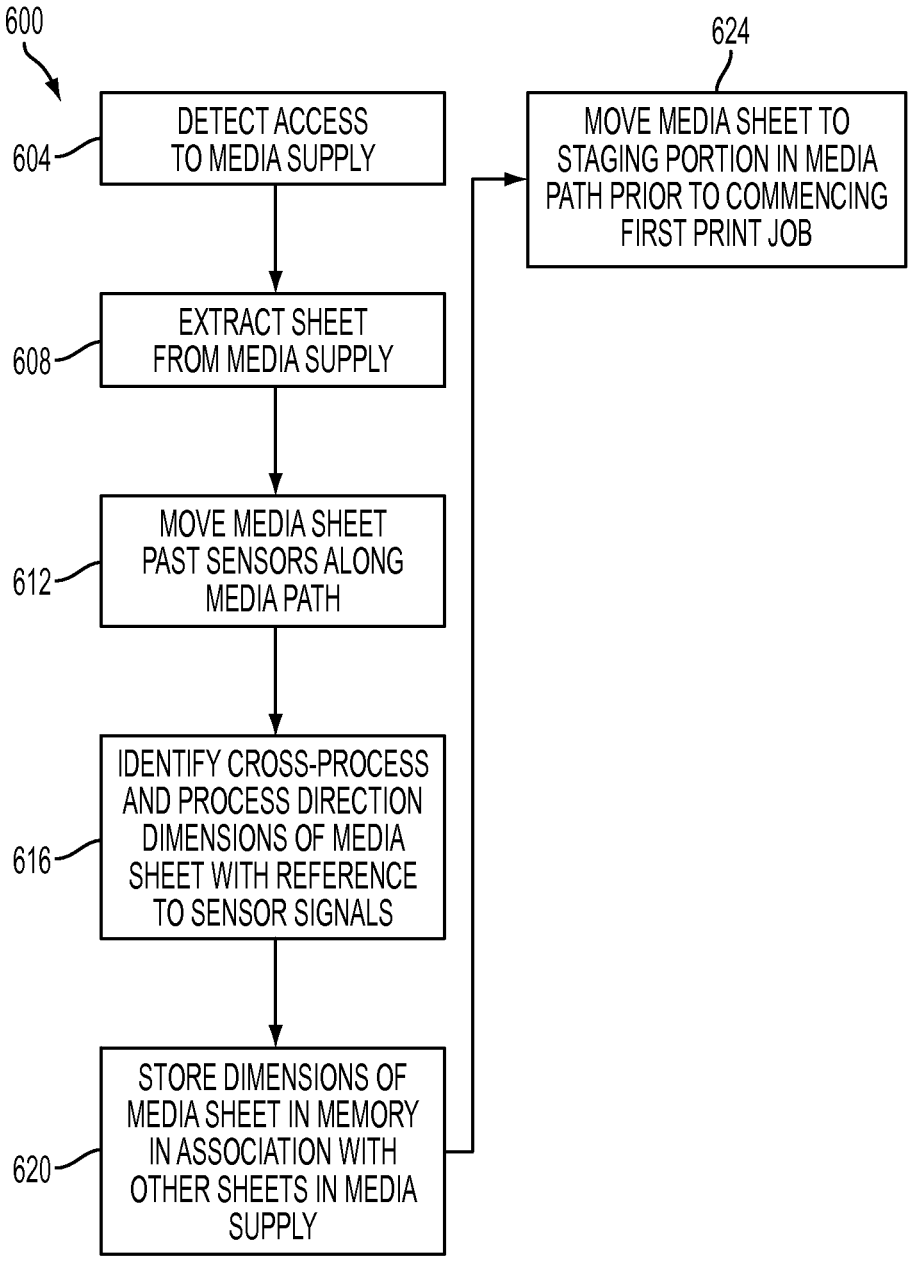
FIG. 6 is a block diagram of a process for identifying the dimensions of a media sheet in a printer that does not include sheet size sensors in a media supply.

FIG. 6 depicts a process 600 for identifying the cross-process direction and process direction dimensions of a media sheet in a printer without requiring media sheet size sensors in the media supply. As used in this document, a reference to a process performing or doing some function or event refers to a controller configured to implement the process performing the function or event or operating a component to perform the function or event. Process 600 is described in conjunction with the printer 10 of FIG. 1 for illustrative purposes.

Process 600 begins when the printer 10 detects access to a media supply (block 604). In the printer 10, the media supplies 42, 44, and 48 are each configured as slideable drawers. An operator slides a drawer for one of the media supplies outward from the housing 11 to add new media sheets to the media supply. Sometimes the newly added media sheets have a different size than media sheets that were previously loaded in the media supply. For example, the media supply 42 can be loaded with letter sized media sheets, but an operator opens the drawer in media supply 42 and replaces the letter sized media with legal sized (8.5"×14") media. A drawer sensor 43 generates a signal when the operator opens the drawer in the media supply 42. In one embodiment, the drawer sensor 43 is a contact switch that is opened when the operator opens the drawer, and is closed when the operator closes the drawer. The media supplies 44 and 48 include similar drawer sensors 45 and 49, respectively.

Process 600 continues by extracting a first sheet from the media supply (block 608). In the printer 10, once the controller 80 detects that one of the drawers in the media supplies 42, 44, and 48 has been opened and closed, the controller 80 activates the media transport 50 to extract a media sheet from the corresponding media supply. The media transport 50 moves the media sheet, referenced at media sheet 49 in FIG. 1, in the process direction P toward the print zone including the transfix nip 18 in the printer 10, or toward a series of inkjets in a printer that ejects ink onto the media sheet 49 directly.

The extracted media sheet continues in the process direction past media sensors arranged along the media path (block 612). In the printer 10, the media sheet 49 moves past the skew sensors 64 in the media path prior to reaching the transfix nip 18 in the print zone and also moves past the optical sensor 68 after passing through the print zone. The controller 80 receives signals from either or both of the sensors 64 and 68 as the media sheet passes the sensors.

In process 600, the controller 80 identifies both the process-direction and cross-process direction dimensions of the media sheet 49 with reference to the signals from the sensors 64 and 68 (block 616). As described above in FIG. 2A-FIG. 4B, different embodiments of the skew sensors 64 can detect whether the media sheet 49 is greater than or less than a predetermined size in the cross-process direction and can detect the size of the media sheet 49 in the process direction. As depicted in FIG. 5A and FIG. 5B, the optical sensor 68 identifies both the cross-process and process direction dimensions of the media sheet 49 after the media sheet 49 passes through the print zone. The controller 80 can average or otherwise combine the media sheet sizes identified by both the skew sensors 64 and the optical sensor 68 to increase the accuracy of detection of the cross-process and process direction dimensions of the media sheet 49. In alternative embodiments, the printer 10 identifies the dimensions of the print medium 49 using only the skew sensors 64 or only the optical sensor 68.

After identifying the size of one media sheet, process 600 stores the identified dimensions in a memory to identify the remaining media sheets held in the media supply (block 620). In the printer 10, the controller 80 stores data corresponding to the identified cross-process direction dimension and process direction dimension of the media sheet 49 in the memory 84. In the illustrative description of process 600 presented herein, the data are stored in conjunction with the remaining sheets in the media supply 42. The memory 84 is configured to store separate sheet dimension data for each of the media supplies 42, 44, and 48.

In process 600, the media sheet 49 moves to a staging portion of the media path once the printer identifies the dimensions of the media sheet (block 624). As used herein, the term "staging portion" can refer to any portion of the media path where the media sheet 49 can be stored prior to initiation of a print job to print ink images onto one or both sides of the media sheet 49. In the printer 10, the media transport moves the media sheet 49 into the duplex media path in the duplex process direction P' to store the media sheet 49 in the media path prior to using the media sheet 49 in an imaging operation. In another printer embodiment, the skew sensors 64 are located at a sufficiently large distance from the print zone that the entire media sheet 49 passes the skew sensors 64 prior to reaching the print zone. The printer stores the media sheet 49 in the portion of the media path before the print zone and resumes moving the media sheet 49 through the print zone after commencing an imaging operation.

In the example of the printer 10, the media sheet 49 passes through the print zone without receiving any ink images during process 600. The inkjets in the printhead units 32 and 34 do not eject ink drops and the printer 10 does not transfix an ink image onto the media sheet 49. During process 600, the transfix roller 17 can be removed from engagement with the imaging drum 12 to enable the media sheet 49 to pass through the print zone with minimal contact to the imaging drum 12. The media sheet 49 remains blank during process 600 and can be used in an imaging operation in a print job that begins after process 600 concludes. The printer 10 typically begins the imaging operation shortly after process 600 identifies the size of the media sheet in the media path. The media sheet 49 remains in the staging portion of the media path until the printer 10 receives a print job. The printer 10 prints an ink image on the media sheet 49 as the first sheet in the print job. Consequently, process 600 identifies the dimensions of sheets inserted into a media supply without requiring dedicated sheet size sensors in the media supply and without requiring manual entry of the dimensions of the media sheets from an operator. The printer 10 consumes the first sheet from the media stack during the print job.

Variants of the above-disclosed and other features and functions, or alternatives thereof, may be combined into many other different devices, applications or methods. Various presently unforeseen or unanticipated alternatives, modifications, variations or improvements therein may be subsequently made by those skilled in the art, which are also intended to be encompassed by the following claims.

We claim:

1. A printer comprising:

a media supply configured to store a plurality of media sheets;

a media transport device configured to extract one media sheet from the plurality of media sheets in the media supply and move the one media sheet in a process direction through a media path in the printer;

a plurality of sensors arranged in a cross-process direction across the media path, the plurality of sensors including a first sensor arranged on a first side of the media path and a second sensor arranged across from the first sensor in the cross-process direction on a second side of the media path;

a staging portion of the media path located in the process direction to receive the one media sheet after the one media sheet has passed the plurality of sensors;

a print zone located along the media path;

a controller operatively connected to the media transport device and the plurality of sensors, the controller being configured to:

operate the media transport device to extract one media sheet from the plurality of media sheets in the media supply and move the one media sheet in the process direction along the media path;

identify a cross-process direction dimension of the one media sheet with reference to a plurality of signals generated by the plurality of sensors in response to the one media sheet moving through the media path past the plurality of sensors;

identify a difference in time between generation of a first signal from the first sensor and generation of a second signal from the second sensor;

identify an alignment of the one media sheet with reference to the identified difference in time;

operate the media transport device to change the alignment of the one media sheet with reference to the identified alignment of the one media sheet;

operate the media transport device to move the one media sheet into the staging portion of the media path;

deactivate the media transport device to hold the one media sheet in the staging portion of the media path prior to the one media sheet entering the print zone; and then move the one media sheet through the print zone in the process direction without forming an image on the one media sheet.

2. The printer of claim 1, the plurality of sensors further comprising:

an array of optical sensors arranged in the cross-process direction across the media path, the array of optical sensors being located along the media path in the process direction from the print zone.

3. The printer of claim 1, the print zone being located in the process direction to receive the one media sheet after the one media sheet has past the plurality of sensors along the media path.

4. A method of operating a printer comprising:

extracting one media sheet from a plurality of media sheets in a media supply with a media transport device;

moving the one media sheet along a media path in a process direction at a predetermined speed with the media transport device past a plurality of sensors arranged in a cross-process direction across the media path;

identifying, with a controller, a cross-process dimension of the one media sheet with reference to a plurality of signals generated by the plurality of sensors in response to the one media sheet moving past the plurality of sensors;

identifying an elapsed time between a first signal being generated by one of the plurality of sensors in response to a first edge of the one media sheet passing the one sensor and a second signal being generated by the one sensor in response to a second edge of the one media sheet passing the one sensor with the controller;

identifying a process direction dimension of the one media sheet with the controller with reference to the elapsed time and the predetermined speed;

continuing to move the one media sheet to a staging portion of the media path located in the process direction from the plurality of sensors; and deactivating the media transport device to hold the one media sheet in the staging portion of the media path; and then moving the one media sheet through a print zone configured to form a printed image on the one media sheet without forming a printed image on the one media sheet, wherein the plurality of sensors include an array of sensors arranged in the cross-process direction across the media path that are located along the media path in the process direction from the print zone.

5. The method of claim 4 further comprising:

identifying with the controller a cross-process direction dimension of each of the plurality of media sheets in the media supply with reference to the identified cross-process direction dimension of the one media sheet.

6. The method of claim 4 further comprising:

generating the plurality of signals with the plurality of sensors, each sensor in said plurality of sensors being an optical sensor configured to generate a signal in response to detecting light reflected from the one media sheet.

7. The method of claim 4 further comprising:

generating the plurality of signals with the plurality of sensors, each sensor in said plurality of sensors being a sensor configured to generate a signal in response to contacting the one media sheet.

8. The method of claim 4 further comprising:

generating a signal with a media supply sensor in response to the media supply being accessed by an operator; and extracting the one media sheet from the plurality of media sheets in the media supply in response to the signal generated by the media supply sensor.

9. A method of operating a printer comprising:

extracting one media sheet from a plurality of media sheets in a media supply with a media transport device;

moving with the media transport device the one media sheet along a media path in a process direction past a plurality of sensors arranged in a cross-process direction across the media path, the plurality of sensors including a first sensor arranged on a first side of the media path and a second sensor arranged across from the first sensor in the cross-process direction on a second side of the media path;

identifying with the controller a difference in time between generation of a first signal from the first sensor and generation of a second signal from the second sensor;

identifying with the controller an alignment of the one media sheet with reference to the identified difference in time; and operating the media transport to change the alignment of the one media sheet with reference to the identified alignment of the one media sheet;

identifying, with the controller, a cross-process dimension of the one media sheet with reference to a plurality of signals generated by the plurality of sensors in response to the one media sheet moving past the plurality of sensors;

continuing to move the one media sheet to a staging portion of the media path located in the process direction from the plurality of sensors; and deactivating the media transport device to hold the one media sheet in the staging portion of the media path; and then moving the one media sheet through a print zone configured to form a printed image on the media sheet without forming a printed image on the media sheet, the print zone being located along the media path in the process direction to receive the one media sheet after the one media sheet has past the plurality of sensors.

* * * * *